US005480209A

United States Patent [19]

May

[11] Patent Number: 5,480,209

[45] Date of Patent: Jan. 2, 1996

[54] MECHANISM FOR WALL-PROXIMITY RECLINING CHAIR

[75] Inventor: Teddy J. May, Tupelo, Miss.

[73] Assignee: The Lane Company, Inc., Altavista, Va.

[21] Appl. No.: 306,956

[22] Filed: Sep. 16, 1994

[51] Int. Cl.[6] ..... A47C 1/035

[52] U.S. Cl. ..... 297/85; 297/83

[58] Field of Search ..... 297/83, 86, 85

[56] References Cited

U.S. PATENT DOCUMENTS 4,108,491 8/1978 Rogers, Jr. ..... 297/85

5,354,116 10/1994 May et al. ..... 297/85

*Primary Examiner*—Kenneth J. Dorner

*Assistant Examiner*—David E. Allred

*Attorney, Agent, or Firm*—Cushman Darby & Cushman

[57] ABSTRACT

A reclining chair mechanism is provided for a wall-proximity reclining chair permitting a chair of normal back height to be stationed as close as three inches to a wall or other structure when the back is upright, and, yet, have sufficient space for the back to recline. Further, in the preferred embodiment, the portions of the side linkages, which support and operate the chair back, are locked against permitting the back to recline from its upright position so long as the operating handle has not been rotated to extend the ottoman from its stowed position.

6 Claims, 3 Drawing Sheets

MECHANISM FOR WALL-PROXIMITY RECLINING CHAIR

BACKGROUND OF THE INVENTION

The invention relates to a reclining chair mechanism which permits the chair to be fully reclined without the top of the back hitting an adjacent wall or other neighboring structure, and in which the back-carrying linkage is locked in its upright position when the ottoman is in its fully retracted position.

In some reclining chairs, as the back is reclined, its upper rear edge is moved substantially rearwardly relative to where the chair base sits on the floor. Accordingly, a significant amount of space, two or three feet in some instances, must be left clear behind the erect chair, so the back can recline without hitting the wall, a lamp, or whatever other structure one might have wanted to have located closely behind the chair.

Others have devised so-called wall-avoiding or wall-proximity recliner chairs. In some, there is a problem that the chair back, due to its cantilevered weight (because it is actually tilted somewhat to the rear even when erect), or as the user leans back on it when the chair is erect, play in the mechanism permits the back to rotate somewhat towards a reclined condition. To some extent, this tendency can be resisted by use of stiff springs on the side linkages located in places where they would need to be resiliently stretched using significant force in order to permit such rotation.

SUMMARY OF THE INVENTION

A reclining chair mechanism is provided for a wall-proximity reclining chair permitting a chair of normal back height to be stationed as close as three inches to a wall or other structure when the back is upright, and, yet, have sufficient space for the back to recline. Further, in the preferred embodiment, the portions of the side linkages, which support and operate the chair back, are locked against permitting the back to recline from its upright position so long as the operating handle has not been rotated to extend the ottoman from its stowed position.

The principles of the invention will be further discussed with reference to the drawings wherein a preferred embodiment is shown. The specifics illustrated in the drawings are intended to exemplify, rather than limit, aspects of the invention as defined in the claims.

Figure 1:
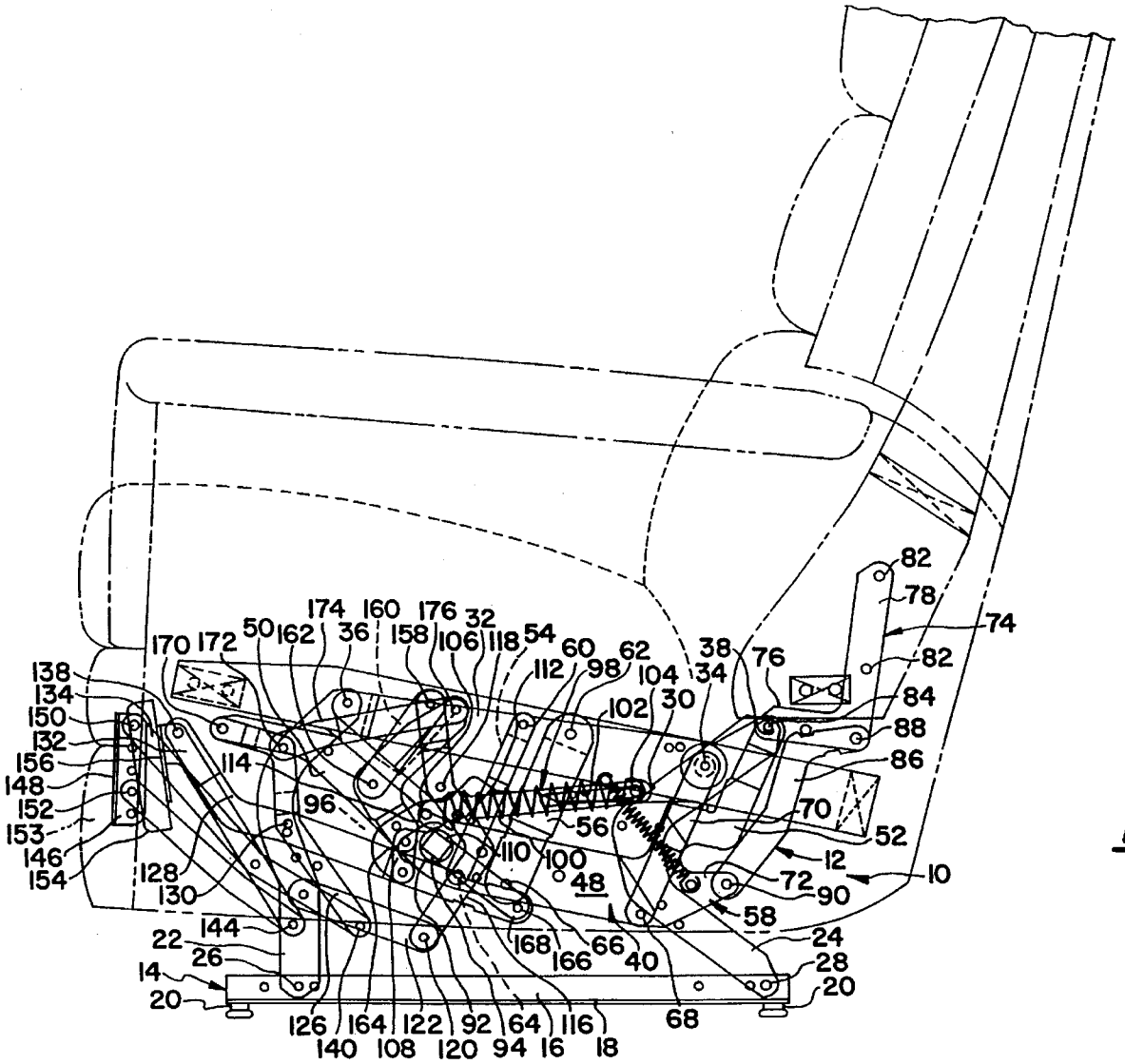
FIG. 1 is a computer-aided drafting schematic side elevational view of a reclining chair provided with a reclining chair mechanism in accordance with the present invention, the chair and mechanism being shown in its fully upright position.

(In the computer-aided drafting views, the links are illustrated as if made of transparent material, so that links and pivots otherwise partly or fully hidden by others, are visible. In fact, the linkages are preferably made of the usual black-painted steel plate, pivot joints, rivets and pins, crank-handled torque tube, nut-and-bolt assemblies securing the torque tube to the left and right side linkages, and cross members uniting the side linkages to provide a reclining chair operating mechanism.)

For clarity, only one of the side linkages is illustrated. The other is its mirror image. The torque tube is provided with a crank handle (e.g., made of furniture-grade wood-resembling molded synthetic plastic material) only at one end.

In describing the side linkages, the term "more medial" will be used to denote a structure which is located relatively closer to the center of the chair, and the term "more lateral" will be used to denote a structure which is located relatively further from the center of the chair. In this context, the term "center" refers to halfway between the right and left extremes of the chair (neglecting such disparities as may be caused by crank-handle protrusion or the chair having an armrest only on one side, as it might, in the case of the chair being part of a multiple seat settee, love seat, console-equipped unit, or the like).

DETAILED DESCRIPTION

On each side linkage 12 of the mechanism 10, the base rail 14 is generally most medially located. It includes an upright laterally outer flange 16 and a medially directed horizontal lower flange 18. Cross-braces 20 of conventional length between the left and right side linkages are bolted to the base rails 14 by nut-and-bolt assemblies (which can also provide rubber or resilient plastic floor-engaging feet, as is conventional; or those elements can be separately provided). The base rail 14 extends in a front-to-rear direction (which will be referred to as the "longitudinal" direction of the chair).

The side linkage 12 further includes a front main support link 22 and a rear main support link 24. Each of these extends generally vertically, is flat in the preferred embodiment, and has its lower end located adjacent the more medial (i.e., the inboard) side of the vertical flange of the base rail.

The lower end of the front main support link 22 is pivoted to the vertical flange 16 of the base rail by a pivot joint 26 near the forward end of the base rail.

The lower end of the rear main support link 24 is pivoted to the vertical flange 16 of the base rail by a pivot joint 28 near the rear end of the base rail.

In the preferred embodiment, the front main support link 22 is slightly reverse question-mark shaped, as seen from its more medial side, and the rear main support link 24 is boomerang C-shaped, with a pin-reception notch 30 provided in its leading edge slightly above its knee bend.

An upper main longitudinal link 32 extends mostly in a vertical plane, having a slight jog to outboards near its forward end, and a frusto-conical outward boss around a pivot joint 34 provided near, but somewhat forwardly of its rear end. Its forward end is located laterally outwardly of the upper end of the front main support link 22, these portions being connected by a pivot joint 36. Its rear end is located laterally outwardly of the upper end of the rear main support link 24, these portions being connected by a pivot joint 38.

A lower main longitudinal link 40 also extends in a vertical plane generally intermediate the base rail 14 and the upper main longitudinal link 32. The link 40, as seen in elevation, is gently arcuate, so that its central portion 48 extends generally horizontally, and its forward and rear portions 50, 52 extend obliquely upwards. These forward and rear portions, have respective folded-to-horizontal, laterally projecting flange portions 42, 44, along upper edges thereof, provided with openings through which a seat and arm frame unit 46 (which may be conventional) can be secured to the mechanism for support and carriage.

In the preferred embodiment, the link 40 is located about 1 ¼ inches outbound of the link 32 but for the rear portion 52 of the link 40, which is jogged laterally and then medially relative to the central and forward portions 48, 50 (for clearing other links during operation).

The lower main longitudinal link 40 is suspended parallelogram-linkage fashion from the upper main longitudinal link 32, by a set of three hanging links, including a forward one 54, a middle one 56 and a rear one 58. Each has an upper end located adjacent the outboard side of the upper longitudinal link and a lower end located adjacent the inboard side of the lower longitudinal link. Respective upper end pivot joints are provided at 60, 62, 34 and respective lower-end pivot joints are provided at 64, 66, 68.

Actually, the rear hanging link 58 is V-shaped, and the joints 34 and 68 are respectively provided at the upper end of its forward leg 70 and at the juncture of its forward leg 70 and its rear leg 72.

Figure 2:
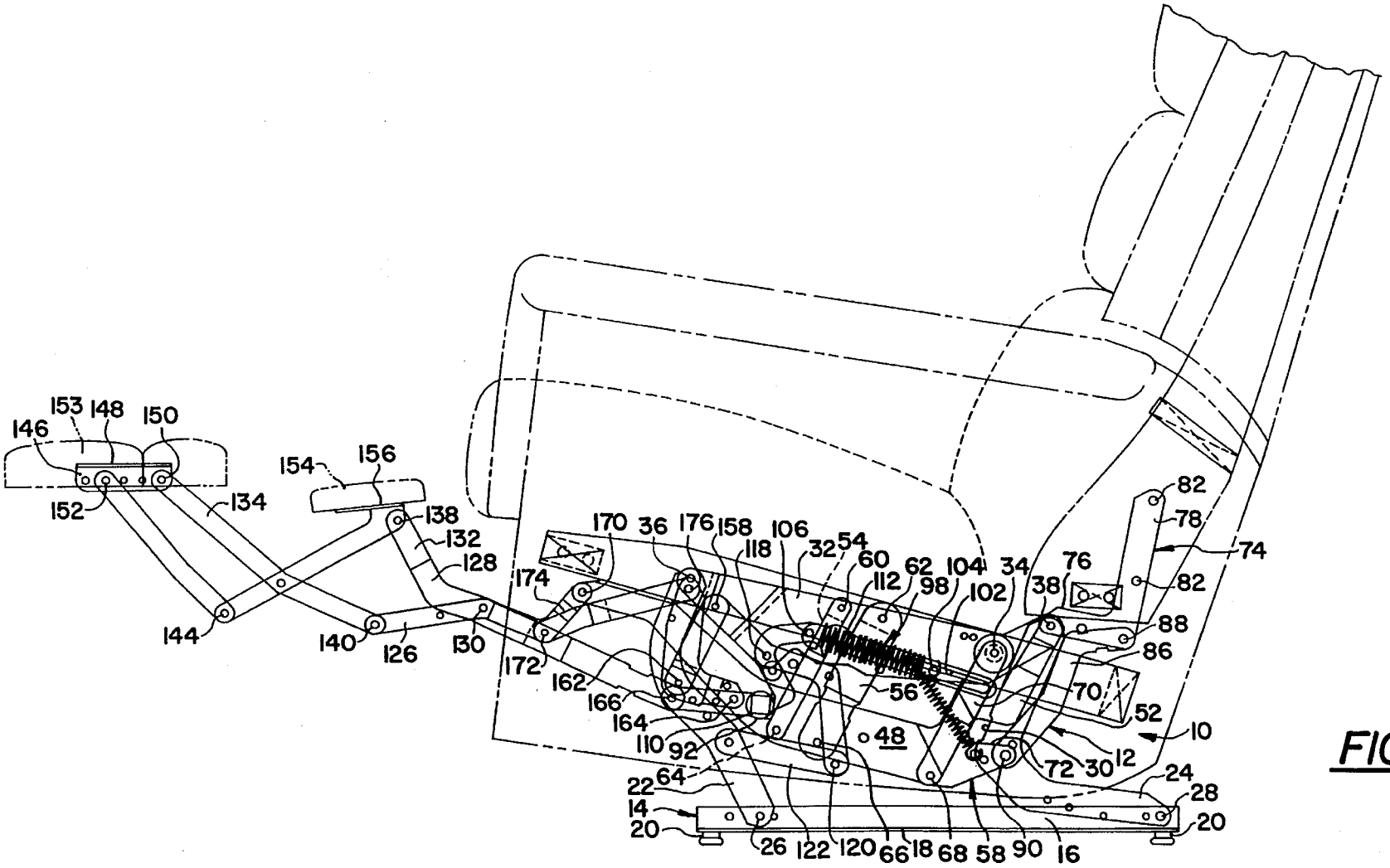
FIG. 2 is a similar view of the chair with its ottoman fully extended but the back remaining upright.

The side linkage 12 further includes a flat, L-shaped back-mounting link 74, having a forwardly projecting lower leg 76, and an upper leg 78 (which projects generally vertically upwards when the chair back is upright, i.e., in the FIG. 1 position or FIG. 2 position). The chair back 80 (which may be conventional) secures to the upper leg 78, e.g., by bolts at 82.

The upper end of the rear portion of the lower main longitudinal link 40 is pivoted to the forward end of the back-mounting link 74 by a transverse horizontal axis pivot joint 84.

The upper end of the rear leg 72 of the rear hanging link 58 is connected to the knee of the back-mounting link 74 by a flat reverse question-mark-shaped driving link 86 at lower and upper pivot joints 88, 90. The lower end of the driving link 86 is located inboard of the leg 72 and the upper end of the driving link 86 is located outboard of the back-mounting link 74.

An opening 92 is provided transversally through the lower main longitudinal link 40 at the bend between its central and forward portions.

In the preferred embodiment, the torque tube 94, which extends transversally between the side linkages and outward through the respective openings 92, actually is provided in two telescopically related interconnected portions which are assembled to one another as the chair is assembled. The crank or operating handle 96 is provided on the outboard end of one of these portions (typically, but not necessarily, on the right side).

On the medial side of the side linkage, a lock 98 is provided for positively preventing reclining of the chair back when the ottoman (yet to be described) is in a retracted (stowed) condition. In its preferred form, the lock 98 includes a long vertical plane generally horizontally extending lock link 100, which is planar, except that it jogs medially where it also curves downwards near its forward end. The rear end is provided with a longitudinally elongated transverse slot 102 which receives a transverse horizontal pin 104 which is fixed on the upper main longitudinal link 32 so as to project medially therefrom. The pin 104 has an enlarged head, so it remains captured for sliding in the slot 102. When the chair is in its FIG. 1 position, the pin 104 is at the rear of the slot 102. The curved-down forward end of the main lock link 100 curves over and down in front of the torque tube 94 (in the FIG. 1 position) and is pivoted by a transverse, horizontal axis pivot joint 106 to the forward, lower end of an asymmetrically M-shaped lock-operating link 108, the rear end of which is fixed by a nut-and-bolt assembly 110 to the torque tube 94. The link 108 is located more medially than the link 100, except that the rear half of its M-shape is twisted ninety degrees from a vertical plane to a horizontal plane so as to wrap around two sides of a square-sectioned portion of the torque tube, at which the link 108 directly underlies the link 100.

Figure 3:
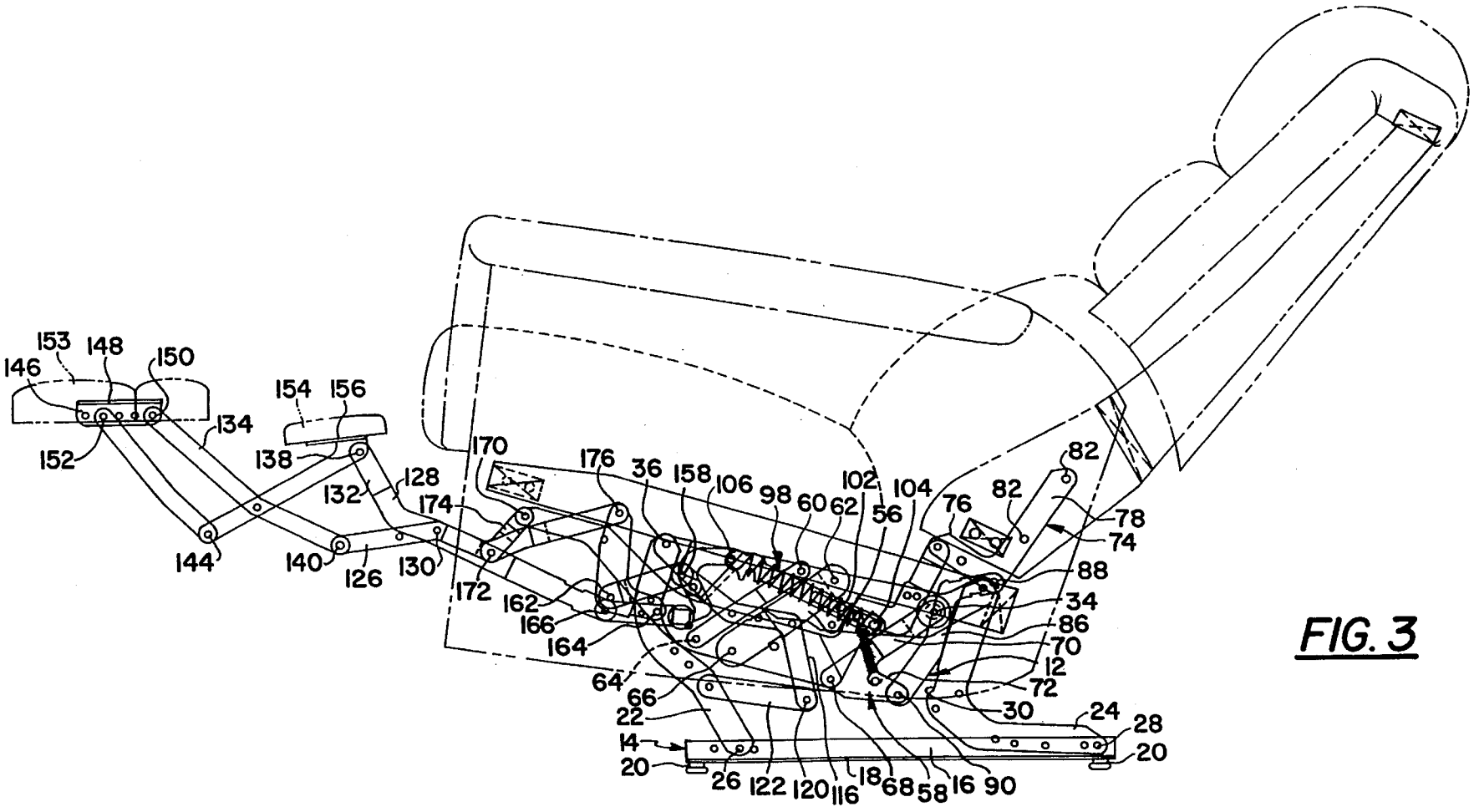
FIG. 3 is a similar view of the chair with its ottoman fully extended and its back fully reclined.

When the chair is in its FIG. 1 position, the crank or operating handle 96 of the torque tube preferably is angled to project upwards and forwards. As it is rotated about the transversally extending longitudinal horizontal axis of the torque tube for extending the ottoman (yet to be described), the torque tube and handle rotate through about one hundred sixty degrees, so that in the FIG. 2 position of the chair (with the back remaining erect, but the ottoman extended), the handle points generally horizontally, rearwardly. As the torque tube rotates, the outer end of the lock operating link swings from being located below and to the front of the torque tube, to being above and to the rear of the torque tube, thus, elevating the main lock link 100, and translating it rearwards, to a limit provided by engagement of the pin 104 with the forward end of the slot 102. Reclining of the chair back (from the FIG. 2 to the FIG. 3 position), translates the torque tube forwardly and upwardly, and, therefore, causes the link 100 to translate forwardly, and upwardly at the front, until the pin 104 again engages the rear end of the slot 102, providing a limit to further reclining of the chair back.

It should now be noticed that there is a downwardly opening, upwardly convergent notch 112 formed in the lower edge of the central region of the main lock link 100, and a horizontal, transverse axis, medially diverted pin 114 fixed on the upper leg of an inverted L-shaped lock pin link 116. The forward end of the link 116 is pivoted to the upper main longitudinal link 32 at a lower region of the latter, forwards of the forward hanging link upper pivot joint 60, at a transverse axis horizontal pivot joint 118. The forward end of the link 116 is located on the outboard side of the longitudinal link 32. The lower end of the link 116 is pivotally connected by a transverse horizontal axis pivot 120 to the rear end of an articulation link 122, the forward end of which is pivotally connected by a transverse, horizontal axis pivot joint to an intermediate-level location on the forward support link 22. In effect, the curvature and articulation provided by the links 116 and 122 and their respective pivotal connections provide space for the torque tube to rotate and translate between the FIGS. 1, 2 and 3 positions, while moving the pin and catch or notch 114 and 112 into and out of locking relation.

The portions of the side linkage, remaining to be described, provide a pantographic mounting for the ottoman, and means for thrusting and retracting the ottoman as the chair is operated between its FIGS. 1 and 2 (on to FIG. 3 and back) and from its FIG. 2 to its FIG. 1 positions. The specific ottoman mounting linkages can be replaced by others known in the art; the one shown is simply a preference.

The pantographic mounting for the ottoman is shown including a pair of rear scissors links 126, 128 pivoted to one another at an intermediate location where they cross, by a transverse, horizontal axis pivot joint 130, a pair of forward scissors links 132, 134 pivoted to one another at an intermediate location where they cross, by a transverse, horizontal axis pivot joint 136.

The upper, rear end of the link 132 is pivoted to the upper front end of the link 128 at a transverse, horizontal axis pivot joint 138.

The lower, rear end of the link 134 is pivoted to the lower front end of the link 126 at a transverse, horizontal axis pivot joint 140.

The lower, forward end of the link 132 of the forward scissors is pivoted to the rear end of a primary ottoman operating link 142 by a transverse, horizontal axis pivot 144. A primary ottoman mounting bracket is shown provided having a vertical flange 146 with a transverse flange 148 extending medially from the upper (FIG. 3) forward (FIG. 1) extent thereof. At two longitudinally spaced sites, the vertical flange 146 is pivoted respectively to the forward ends of the links 134, 142 (which are disposed generally parallel to one another) by transverse, horizontal axis pivot joints 150 and 152.

The primary ottoman 153 (which may be of conventional construction) can be secured, e.g., by bolting through holes or slots in the flange 146, to the side linkage for extension and retraction therewith.

By preference, the linkage 12 also accommodates the mounting of a secondary ottoman 154 (which may be of conventional construction). In the instance depicted, the upper end of the link 132 is provided with an extension flange 156 which projects medially.

The forward end of the link 116 (above and forwardly of the pivot joint 118) is pivotally connected by a transverse, horizontal axis pivot joint 158 to the upper end of a generally vertically extending movement coordinating link 160 which is disposed laterally intermediate the links 116 and 50. The lower end of the coordinating link 160 is pivoted at a transverse, horizontal axis pivot joint 162 to the knee of the L-shaped link 50. The rear end of the lower leg of the L-shaped link 50 is pivoted at a transverse, horizontal axis pivot joint 164 to the lower main longitudinal link 40, immediately forwards of the opening 92 through which the torque tube projects.

The lower, rear end of the rear scissors link 128 is pivoted at a transverse, horizontal axis pivot joint 166 to the radially outer end of an operating link 168, a transverse, inner end flange 170 of which is secured against an outboard portion of the torque tube 94 (immediately beside the handle 96, on the side linkage which has the handle 96).

The upper rear end of the rear scissors link is pivoted to the forward end of the lower main longitudinal link at 170.

Between the pivot joints 130 and 170, a transverse horizontal axis pivot joint 172 pivotally connects the forward, lower end of a control link 174, the upper, rear end of which is pivotally connected by a transverse, horizontal axis pivot joint 176 to the upper end of the L-shaped link 50.

When the chair is in its FIG. 1 position, the leg rest (ottoman) operating link 168 extends rearwardly and downwardly, behind the torque tube. As the handle 96 (and, therefore, the torque tube) is rotated, the link 168 is rotated so as to extend forwardly, in front of the torque tube, in the FIG. 2 position of the chair.

As illustrated (and as will be understood by those skilled in the art), the links are relatively positioned and jogged and notched so as to avoid clashing when the chair is operated. Also, as illustrated (and as will be understood by those skilled in the art), various transverse pins, pin-engagement link edge portions, springs and spring-mounting pins and/or spring-mounting holes through links preferably are provided for limiting movement of respective linkage members relative to one another and/or providing biasing of the linkage members towards a desired relative disposition.

In the illustrated embodiment, as the handle 96 is rotated to extend the ottoman from its stowed position of FIG. 1 to its fully extended position of FIG. 2, the torque tube remains at approximately the same height above the base rail (e.g., about 5 ½ inches) as it and the associated linkage structure on which the seat and arm frame unit of the chair are mounted, are moved forwards about 5 inches. As the back is reclined (by the user leaning or pressing back with their back on the chair back), the torque tube and the associated linkage structure on which the ottoman pantographic linkages are based, are moved forwardly about 2 ½ inches and upwards about an inch, along an upwardly forwardly slanting path.

It should now be apparent that the mechanism for wall-proximity reclining chair as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A mechanism for a wall-proximity reclining chair which has a seat and arm frame unit, a back and a primary ottoman, said mechanism comprising:

a left side linkage including a base rail adapted to support the mechanism on a floor, a right side linkage including a base rail adapted to support the mechanism on a floor, cross members interconnecting corresponding portions of the left and right side linkages and thereby integrating the side linkages into a unitary structure; the left and right side linkages being generally mirror images of one another;

each said side linkage comprising:

an upper main longitudinal link pivotally supported on the respective base rail by respective forward and rear support links having lower ends pivoted to the respective base rail and upper ends pivoted to the respective upper main longitudinal link;

a lower main longitudinal link;

a plurality of longitudinally spaced generally vertical hanging links pivotally hangingly supporting the respective lower main longitudinal link from the respective upper main longitudinal link;

a projectable-retractable pantographic linkage having a forward end and a rear end, the forward end being arranged for mounting a respective end of a transversally extending primary ottoman for projection and retraction with the pantographic linkage; upper and lower rear ends of the pantographic linkage being respectively pivoted to the forward end of the lower main longitudinal link and a radially outer end of an ottoman-operating link;

a transversally extending torque tube, and means for rotating said torque tube about its own transversally extending axis for projecting and retracting said pantographic linkages;

each said side linkage further including:

a connector connecting a radially inner end of the respective ottoman-operating link to the torque tube so that the ottoman operating link rotates with the torque tube;

an L-shaped back-mounting link with upper vertical and lower forwardly projecting legs and adapted to have a chair back mounted thereto; a forward, lower end of the back-mounting link being pivoted to an upper rear portion of the respective lower main longitudinal link;

a V-shaped back-operating link having a pivotal securement to a rear portion of the respective lower main longitudinal link, a forward leg pivotally secured at an upper end thereof to a rear portion of the upper main longitudinal link, and a rear leg pivotally secured at an upper end thereof to a lower end of a driving link that is pivotally connected at an upper end thereof to the respective L-shaped back-mounting link at a juncture between said upper vertical and lower forwardly projecting legs of the respective L-shaped back-mounting link;

a back-reclining prevention lock including a transversally extending first pin provided on an articulated linkage system looping to the rear of the torque tube and pivotally connected at opposite ends thereof to:

the respective forward support link at an intermediate-height location between upper and lower ends of the respective forward support link, below and forwardly of the torque tube, and the respective upper main longitudinal link, above the torque tube; and further including a notch provided in an edge of a lock link; a pin-in-slot slidable connection of a rear end portion of the lock link to the upper main longitudinal link; and a lock opening link secured at a radially inner end thereof to the torque tube and pivotally connected at a radially outer end thereof to a forward end of the respective lock link, so that as the torque tube is rotated in a sense to retract the respective pantographic linkage, the respective notch and first pin are effectively engaged, and, as the torque tube is rotated in a sense to project the respective pantographic linkage, the respective notch and first pin are effectively disengaged, a respective second pin sliding from a rear end to a forward end of the respective pin-in-slot slidable connection as the torque tube is rotated in a sense to project the respective pantographic linkage, and from said forward end to said rear end of the respective pin-in-slot slidable connection as the respective L-shaped back-mounting link is rotated rearwardly corresponding to reclining of the chair back.

2. The mechanism of claim 1, wherein:

said means for rotating the torque tube composes a crank handle secured on an end of the torque tube.

3. The mechanism of claim 2, wherein:

said torque tube projects laterally outwardly through correspondingly located openings provided through said lower main longitudinal links of said left and right side linkages.

4. The mechanism of claim 3, wherein:

each said pin-in-slot slidable connection includes a longitudinally extending slot on the respective lock link and a medially projecting pin based on the respective upper main longitudinal link.

5. The mechanism is claim 1, wherein:

each said lower main longitudinal link includes transversally projecting flanges arranged for mounting of respective sides of a seat and arm frame unit thereto.

6. The mechanism of claim 1, wherein:

said pantographic linkages further include correspondingly located securement sites provided thereon for mounting respective ends of a transversally extending secondary ottoman thereto.

* * * * *